US011555403B2

(12) United States Patent
Niederriter et al.

(10) Patent No.: US 11,555,403 B2
(45) Date of Patent: Jan. 17, 2023

(54) CUTTING PICK MONITORING SYSTEM AND METHOD FOR LONGWALL MINING SYSTEM

(71) Applicant: Joy Global Underground Mining LLC, Warrendale, PA (US)

(72) Inventors: Edward F. Niederriter, Fryburg, PA (US); Jeffrey A. Ley, Cranberry, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

(21) Appl. No.: 17/200,348

(22) Filed: Mar. 12, 2021

(65) Prior Publication Data

US 2021/0285327 A1 Sep. 16, 2021

Related U.S. Application Data

(60) Provisional application No. 62/989,323, filed on Mar. 13, 2020.

(51) Int. Cl.

| | |
|---|---|
| ***E21C 35/24*** | (2006.01) |
| ***E21C 25/10*** | (2006.01) |
| ***E21C 35/18*** | (2006.01) |

(52) U.S. Cl.

CPC ..... *E21C 25/10* (2013.01); *E21C 35/18* (2013.01); *E21C 35/24* (2013.01)

(58) Field of Classification Search

CPC ..... E21C 35/24; E21C 35/18; E21C 25/10

See application file for complete search history.

(56) References Cited

U.S. PATENT DOCUMENTS

| | | | |
|---|---|---|---|
| 4,281,876 | A | 8/1981 | Lansberry |
| 4,715,657 | A | 12/1987 | Sato et al. |
| 5,871,260 | A | 2/1999 | Delli-Gatti, Jr. |
| 6,296,317 | B1 | 10/2001 | Ollis et al. |
| 8,386,196 | B2 | 2/2013 | Wagner et al. |

(Continued)

FOREIGN PATENT DOCUMENTS

| | | | |
|---|---|---|---|
| AU | 2015383068 | A1 | 2/2017 |
| DE | 3616170 | A1 | 3/1987 |
| WO | 2020043529 | A1 | 3/2020 |

OTHER PUBLICATIONS

Chinese Patent Office Action for Application No. 202120534406.3 dated Apr. 2, 2022 (3 pages, including an English statement of relevance).

(Continued)

*Primary Examiner* — Janine M Kreck

(74) *Attorney, Agent, or Firm* — Michael Best & Friedrich LLP

(57) ABSTRACT

A longwall mining system including a longwall shearer having cutting drums. The cutting picks on the cutting drum are monitored for wear using imaging devices mounted to the longwall mining system. Methods for monitoring wear includes a controller receiving image data from an imaging device directed at a cutting drum of a shearer. The controller analyzes the image data to determine a wear level of a cutting pick on the cutting drum. The controller then determines the wear level exceeds a wear threshold and, in response, generates an alert indicating that the cutting pick is worn in response to determining that the wear level exceeds the wear threshold.

19 Claims, 13 Drawing Sheets

(56) References Cited

U.S. PATENT DOCUMENTS

| | | | | |
|---|---|---|---|---|
| 8,775,099 | B2 * | 7/2014 | Wagner | E21C 35/00 404/94 |
| 8,944,518 | B2 | 2/2015 | von Schoenebeck et al. | |
| 8,963,247 | B2 * | 2/2015 | Hurwitz | H01L 21/84 257/347 |
| 9,140,120 | B2 | 9/2015 | Niederriter et al. | |
| 9,175,448 | B2 | 11/2015 | von Schoenebeck et al. | |
| 9,797,245 | B2 | 10/2017 | von Schoenebeck et al. | |
| 9,863,247 | B2 | 1/2018 | von Der Lippe et al. | |
| 9,873,994 | B2 | 1/2018 | Wagner et al. | |
| 9,965,864 | B2 | 5/2018 | Herdle | |
| 10,167,721 | B2 | 1/2019 | Bemning et al. | |
| 10,287,882 | B2 | 5/2019 | Barimani et al. | |
| 10,385,688 | B2 | 8/2019 | Laclef et al. | |
| 10,404,948 | B2 | 9/2019 | Rahms et al. | |
| 10,416,056 | B2 | 9/2019 | Paulsen et al. | |
| 2016/0298452 | A1 | 10/2016 | Doheny, II et al. | |
| 2017/0356730 | A1 * | 12/2017 | Wang | E21C 37/12 |
| 2018/0202117 | A1 | 7/2018 | Wagner et al. | |

OTHER PUBLICATIONS

Peng, "Automation in U.S longwall coal mining: A state-of-the-art review", International Journal of Mining and Science and Technology, vol. 29, Issue 2, 2019, pp. 151-159.

Wirtgen Group, "WIRTGEN GmbHAnimation Surface Miner: Wirtgen Pick Inspection", <https:www.youtube.com/watch?v=k19_VWxc6F8>, Aug. 11, 2016, 8 pages.

Si et al., "Online Identification of Shearer Cutting State Using Infrared Thermal Images of Cutting Unit", Appl. Sci., vol. 8, 2018, 19 pages.

* cited by examiner

CUTTING PICK MONITORING SYSTEM AND METHOD FOR LONGWALL MINING SYSTEM

RELATED APPLICATIONS

This application claims priority to U.S. Provisional Patent Application No. 62/989,323, filed Mar. 13, 2020, the disclosure of which is hereby incorporated by reference.

FIELD

The present application relates to monitoring cutting picks on a shearer in a longwall mining system.

BACKGROUND

Longwall mining begins with identifying a material seam to be mined and "blocking out" the seam into panels by excavating roadways around the perimeter of each panel. During excavation of the seam (e.g., extraction of coal), select pillars of material can be left unexcavated between adjacent panels to assist in supporting the overlying geological strata. The material panels are excavated by a longwall mining system, which includes components such as automated electro-hydraulic roof supports, a material shearing machine (i.e., a longwall shearer), and an armored face conveyor ("AFC") parallel to the material face. As the shearer travels the width of the material face, cutting drums of the shearer are rotated to remove a layer or web of material. Additionally, as the shearer travels the width of the material face, the roof supports automatically advance to support the roof of the newly exposed section of strata. The AFC is then advanced by the roof supports toward the material face by a distance equal to the depth of the material layer previously removed by the shearer. Advancing the AFC toward the material face in such a manner allows the shearer to engage with the material face and continue shearing material away from the material face.

The cutting drums of the shearer include cutting picks that cut into the material face to shear away the material. Over time, the cutting picks wear down and their effectiveness at cutting material is reduced.

SUMMARY

It can be difficult to inspect cutting picks on a shearer to assess whether the cutting picks should be replaced. For example, to inspect cutting picks manually, the shearer may be powered down, halting production, and a mine worker may approach the cutting drum to visually inspect the cutting picks.

Embodiments provided herein relate to systems and methods for monitoring wear of cutting picks on cutting drums of a shearer in a longwall mining system. In some embodiments, the systems and methods enable remote monitoring without manual inspection by mine workers at the material face. In some embodiments, the systems and methods enable quicker, more frequent, and more accurate assessments of the cutting picks as compared to manual inspection.

Embodiments described herein also provide a method of monitoring a longwall mining system. The method includes a controller receiving image data from an imaging device directed at a cutting drum of a shearer. The controller analyzes the image data to determine a wear level of a cutting pick on the cutting drum. The controller then determines the wear level exceeds a wear threshold and, in response, generates an alert indicating that the cutting pick is worn in response to determining that the wear level exceeds the wear threshold.

In some embodiments of the method, generating the alert includes controlling an electronic display screen to display the alert.

In some embodiments, the method further includes receiving, by the controller, further image data from a second imaging device directed at a second cutting drum of the shearer. The controller analyzes the further image data to determine a wear level of a second cutting pick on the second cutting drum. The control then determines that the wear level of the second cutting pick exceeds the wear threshold and, in response, generates a second alert that indicates that the second cutting pick is worn.

In some embodiments, the method further includes receiving, by the controller, further image data from the imaging device. The further image data is generated by the imaging device after the shearer moves relative to the imaging device such that the imaging device is directed at a second cutting drum of the shearer. The controller analyzes the further image data to determine a wear level of a second cutting pick on the second cutting drum. The controller then determines that the wear level of the second cutting pick exceeds the wear threshold and, in response, generates a second alert indicating that the second cutting pick is worn.

In some embodiments, the method further includes operating the shearer of the longwall mining system to mine material from a mine face, wherein operation of the shearer includes controlling the shearer to move along the mine face and controlling the cutting drum to rotate; stopping movement of the shearer along the mine face; and controlling the cutting drum to rotate after the shearer has stopped to clear loose material from the cutting drum. The image data received from the imaging device is captured after the loose material is cleared. In some embodiments, stopping movement of the shearer along the mine face includes determining that a cutting drum of the shearer is aligned with an imaging device for capture of the image data; and, in response to determining that the cutting drum of the shearer is aligned with the imaging device, stopping movement of the shearer along the mine face.

Embodiments described herein provide a longwall mining control system. The system includes an imaging device directed at a cutting drum of a shearer in the longwall mining system; and a controller coupled to the imaging device. The controller includes an electronic processor and a memory, and is configured to receive image data from the imaging device. The controller is further configured to analyze the image data to determine a wear level of a cutting pick on the cutting drum; determine that the wear level exceeds a wear threshold; and generate an alert indicating that the cutting pick is worn in response to determining that the wear level exceeds the wear threshold.

In some embodiments of the system, generating the alert includes controlling an electronic display screen to display the alert.

In some embodiments, the system further includes a second imaging device directed at a second cutting drum of the shearer, and the second imaging device is coupled to the controller. The controller is further configured to analyze the further image data to determine a wear level of a second cutting pick on the second cutting drum; determine that the wear level of the second cutting pick exceeds the wear threshold; and generate a second alert in response to determining that the wear level of the second cutting pick exceeds the wear threshold. The second alert indicates that the second cutting pick is worn.

In some embodiments of the system, the controller is further configured to receive further image data from the imaging device. The further image data is generated by the imaging device after the shearer moves relative to the imaging device such that the imaging device is directed at a second cutting drum of the shearer. The controller is further configured to analyze the further image data to determine a wear level of a second cutting pick on the second cutting drum; determine that the wear level of the second cutting pick exceeds the wear threshold; and generate a second alert in response to determining that the wear level of the second cutting pick exceeds the wear threshold. The second alert indicates that the second cutting pick is worn.

In some embodiments of the system, the controller is further configured to operate the shearer of the longwall mining system to mine material from a mine face, wherein operation of the shearer includes controlling the shearer to move along the mine face and controlling the cutting drum to rotate; stop movement of the shearer along the mine face; and control the cutting drum to rotate after the shearer has stopped to clear loose material from the cutting drum. The the image data received from the imaging device is then captured after the loose material is cleared. In some embodiments of the system, to stop movement of the shearer along the mine face, the controller is configured to: determine that a cutting drum of the shearer is aligned with an imaging device for capture of the image data; and, in response to determining that the cutting drum of the shearer is aligned with the imaging device, stop movement of the shearer along the mine face.

Embodiments described herein provide a longwall mining system. The system includes a longwall shearer configured to move along a mine face and a first cutting drum provided on the longwall shearer having a first plurality of cutting picks configured to cut material from the mine face as the longwall shearer moves along the mine face. The system also includes a first imaging device configured to capture one or more images of the first cutting drum and a first arm movable between a first position and a second position. The first imaging device is mounted to the first arm. When the first arm is in the first position the first cutting drum is within a line of sight of the first imaging device, and when the first arm is in the second position the first cutting drum is out of view of the first imaging device. The system includes an electronic processor electrically coupled to the longwall shearer, the first cutting drum, the first arm, and the first imaging device system. The electronic processor is configured to control the first arm to move to the first position and capture, using the first imaging device, a first image of at least one of the cutting picks of the first plurality of cutting picks. The electronic processor is also configured to analyze the first image to determine a first wear level of the at least one cutting pick of the first plurality of cutting picks and determine that the first wear level exceeds a wear threshold. The electronic processor is further configured to generate a first alert indicating that the at least one cutting pick of the first plurality of cutting picks is worn in response to determining that the first wear level exceeds the wear threshold.

Embodiments described herein provide a method for monitoring a longwall mining system including a longwall shearer configured to move along a mine face and a first cutting drum provided on the longwall shearer and including a first plurality of cutting picks configured to cut material from the mine face as the longwall shearer moves along the mine face. The method includes controlling, using an electronic processor of the longwall mining system, a first arm to move to a first position. A first imaging device is mounted to the first arm. The first arm is movable between the first position and a second position. When the first arm is in the first position the first cutting drum is within a line of sight of the first imaging device and when the first arm is in the second position the first cutting drum is out of view of the first imaging device. The method also includes capturing, using the first imaging device, a first image of at least one of the cutting picks of the first plurality of cutting picks and analyzing, using the electronic processor, the first image to determine a first wear level of the at least one cutting pick of the first plurality of cutting picks. The method further includes determining, using the electronic processor, that the first wear level exceeds a wear threshold and generating, using the electronic processor, a first alert indicating that the at least one cutting pick of the first plurality of cutting picks is worn in response to determining that the first wear level exceeds the wear threshold.

Before any embodiments are explained in detail, it is to be understood that the embodiments are not limited in its application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components, may be utilized to implement the embodiments. For example, "servers," "computing devices," "controllers," "processors," etc., described in the specification can include one or more processing units, one or more computer-readable medium modules, one or more input/output interfaces, and various connections (e.g., a system bus) connecting the components.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4". The relative terminology may refer to plus or minus a percentage (e.g., 1%, 5%, 10%, or more) of an indicated value.

Functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not explicitly listed.

Other aspects of the embodiments will become apparent by consideration of the detailed description and accompanying drawings.

DETAILED DESCRIPTION

Embodiments provided herein relate to systems and methods for monitoring wear of cutting picks on cutting drums of a shearer in a longwall mining system. In some embodiments, the systems and methods enable remote monitoring by mine workers at the material face. In some embodiments, the systems and methods enable quicker, more frequent, and more accurate assessments of the cutting picks as compared to manual inspection.

Figure 1:
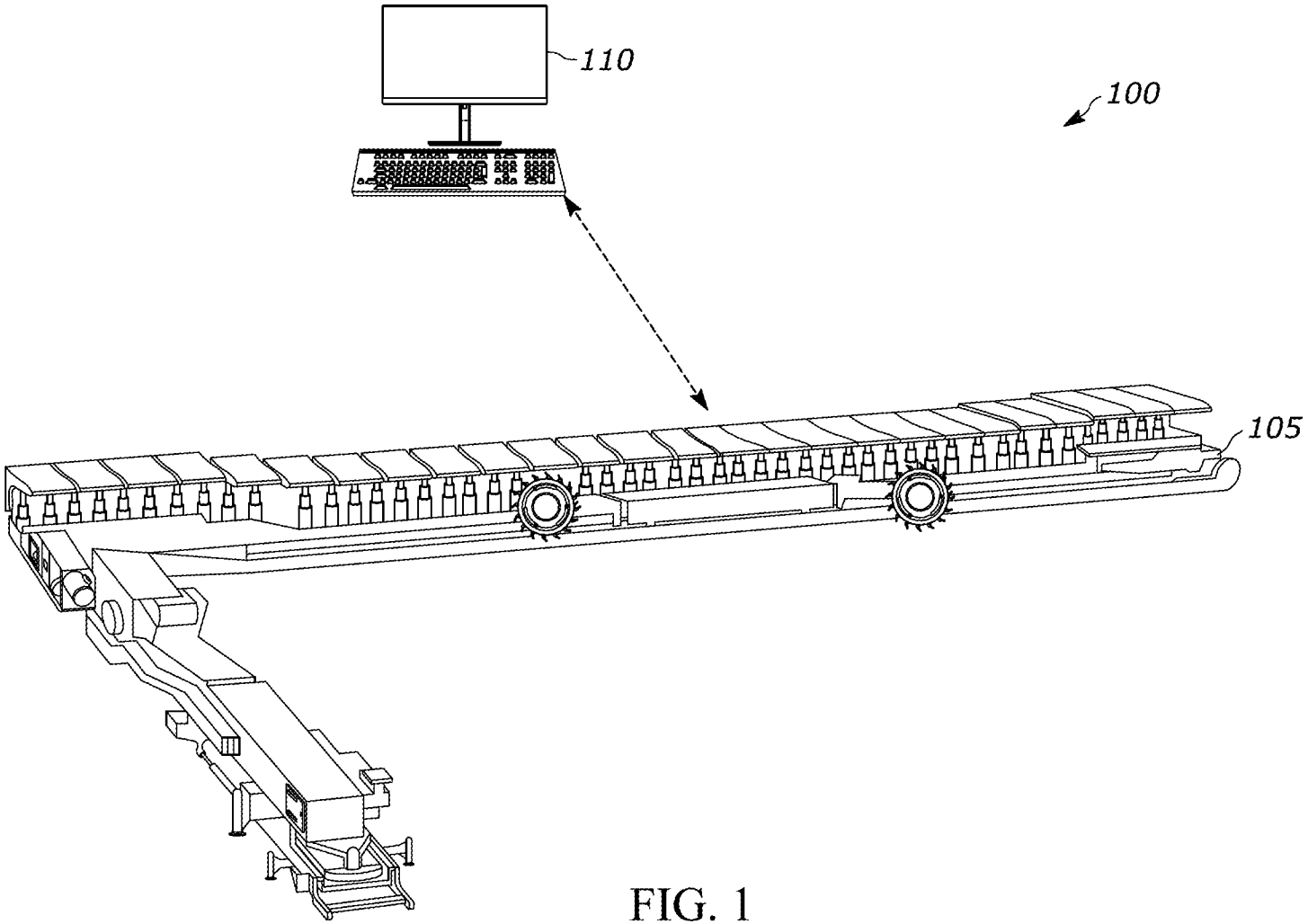
FIG. 1 is a schematic diagram of an extraction system according to some embodiments

FIG. 1 illustrates a longwall mining extraction system 100. The extraction system 100 includes a longwall mining system 105 and a mine monitoring system 110. The extraction system 100 is configured to extract a material or product (e.g., coal or other ores) from a mine in an efficient manner. The longwall mining system 105 physically extracts material from an underground mine. The mine monitoring system 110 monitors the operation of the longwall mining system 105 to ensure that the extraction of material remains efficient. Although illustrated as a single device, the mine monitoring system may include several computing devices located remotely from the mine site, at the surface of the mine site, or underground at the mine site (see, e.g., FIG. 7).

Figure 2:
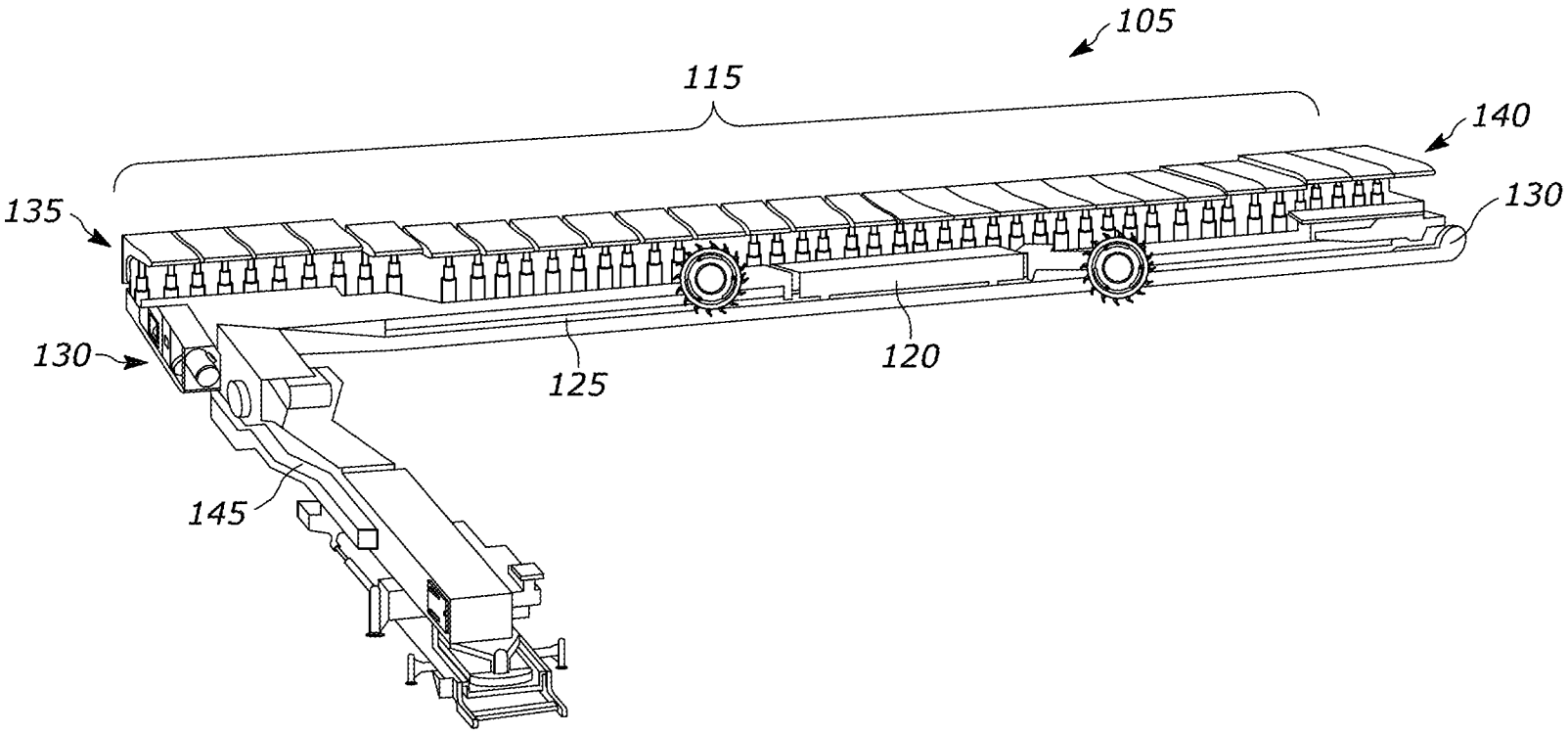
FIG. 2 illustrates a longwall mining system of the extraction system of FIG. 1.

FIG. 2 illustrates the longwall mining system 105 including roof supports 115 and a longwall shearer 120. The roof supports 115 are interconnected parallel to a material face (see FIG. 5) by electrical and hydraulic connections. The roof supports 115 shield the shearer 120 from the overlying geological strata. The number of roof supports 115 used in the longwall mining system 105 depends on the width of the material face being mined since the roof supports 115 are intended to protect the full width of the material face from the strata. The shearer 120 is propagated along the line of the material face by an armored face conveyor (AFC) 125, which has a dedicated rack bar for the shearer 120 running parallel to the material face between the face itself and the roof supports 115. The AFC 125 also includes a conveyor parallel to the shearer rack bar, such that excavated material falls onto the conveyor to be transported away from the face. The conveyor and rack bar of the AFC 125 are driven by AFC drives 130 (for example, a first AFC drive mechanism and a second AFC drive mechanism) located at a maingate 135 and a tailgate 140, which are at distal ends of the AFC 125. That is, the AFC 125 includes a maingate end and a tailgate end with the first AFC drive mechanism provided at the maingate end and the second AFC drive mechanism provided at the tailgate end. The AFC drives 130 allow the AFC 125 to continuously transport material toward the maingate 135 (left side of FIG. 2). The AFC drives 130 also allow the shearer 120 to be hauled bi-directionally along the rack bar of the AFC 125 and across the material face. In some embodiments, depending upon the specific mine layout, the layout of the longwall mining system 105 can be different than described above. For example, the maingate 135 can be on the right distal end of the AFC 125 and the tailgate 140 can be on the left distal end of the AFC 125. The longwall mining system 105 also includes a beam stage loader ("BSL") 145 arranged perpendicularly at the maingate 135 of the AFC 125.

Figure 3A:
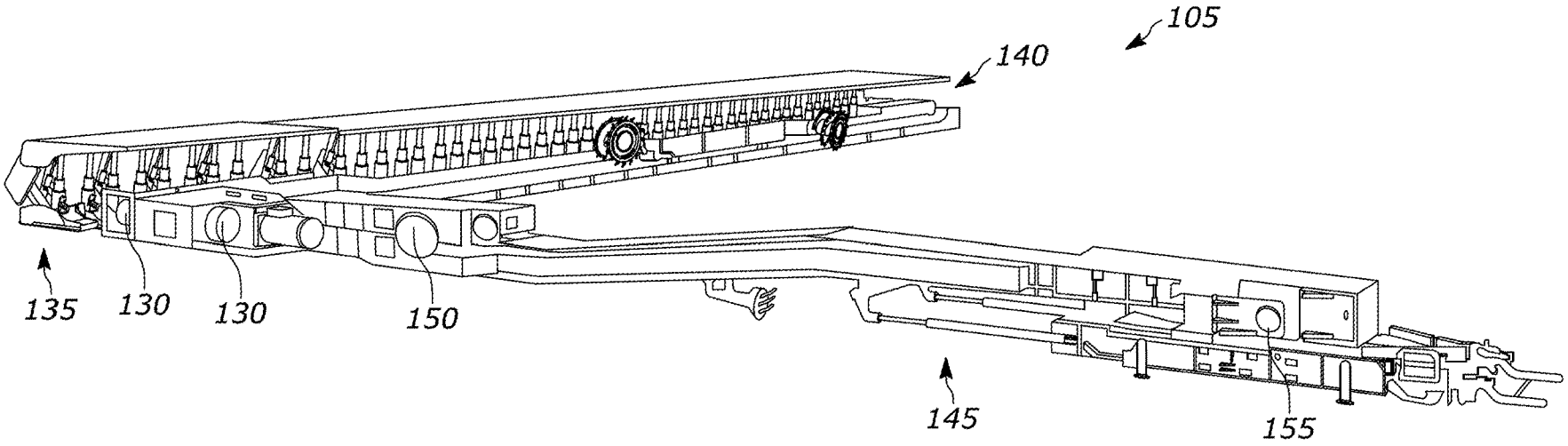
FIG. 3A illustrates another view of the longwall mining system FIG. 2.
Figure 3B:
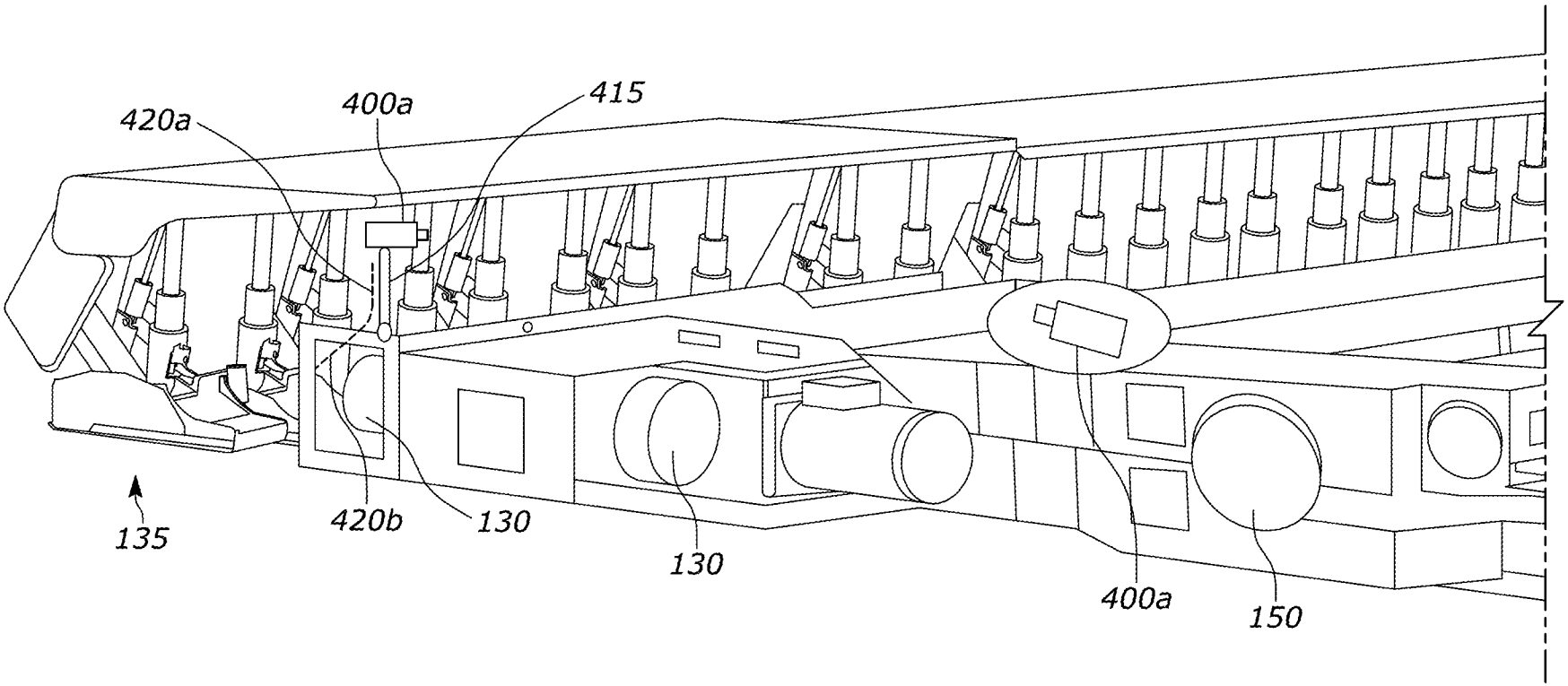
FIGS. 3B-3C illustrate enlarged, partial views of the longwall mining system of FIG. 3A.
Figure 3C:
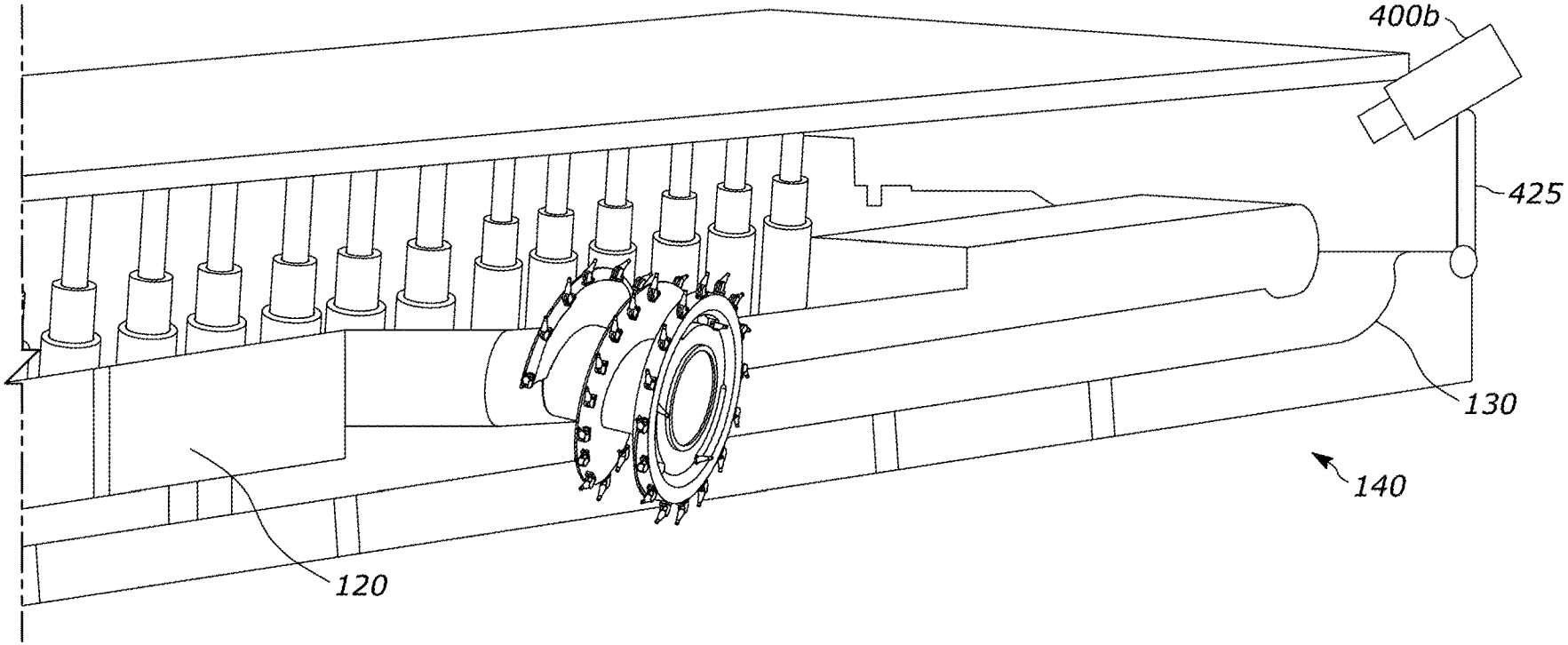

FIG. 3A illustrates a perspective view of the longwall mining system 105 and an expanded view of the BSL 145. FIGS. 3B and 3C illustrate enlarged partial views of the maingate area and tailgate area, respectively, of the longwall mining system 105 of FIG. 3A. When the won material hauled by the AFC 125 reaches the maingate 135, it is routed through a ninety degree (90°) turn onto the BSL 145. In some instances, the BSL 145 interfaces with the AFC 125 at an oblique angle (e.g., a non-right angle). The BSL 145 then prepares and loads the material onto a maingate conveyor (not shown), which transports the material to the surface. The material is prepared to be loaded by a crusher or sizer 150, which breaks down the material to improve loading onto the maingate conveyor. Similar to the conveyor of the AFC 125, the BSL 145's conveyor is driven by a BSL drive 155.

Figure 4A:
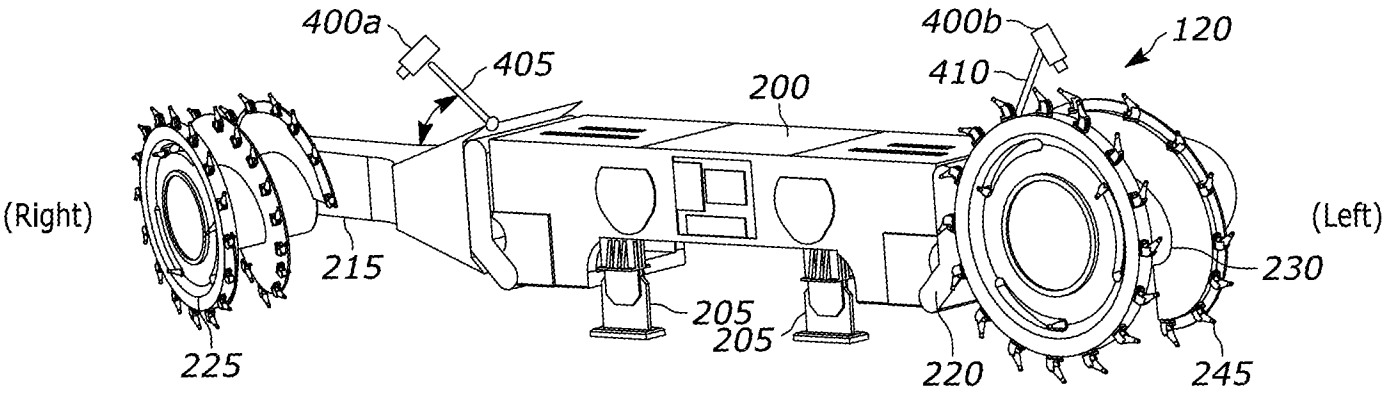
FIGS. 4A-4C illustrate a longwall shearer of the longwall mining system of FIG. 2.
Figure 4B:
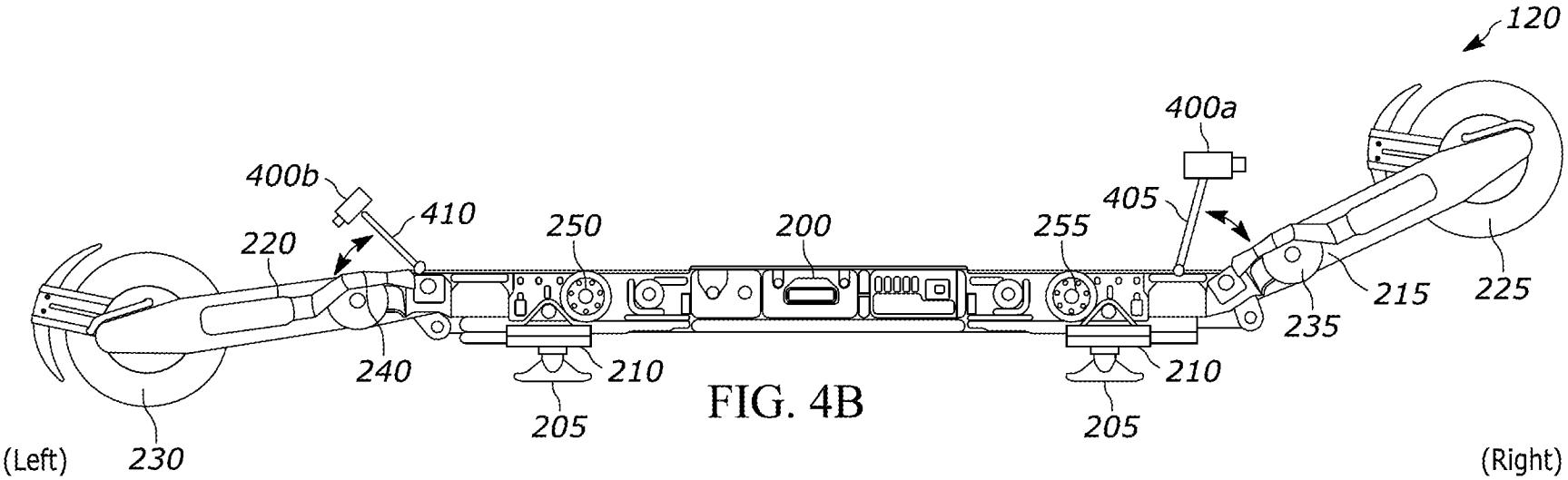
Figure 4C:
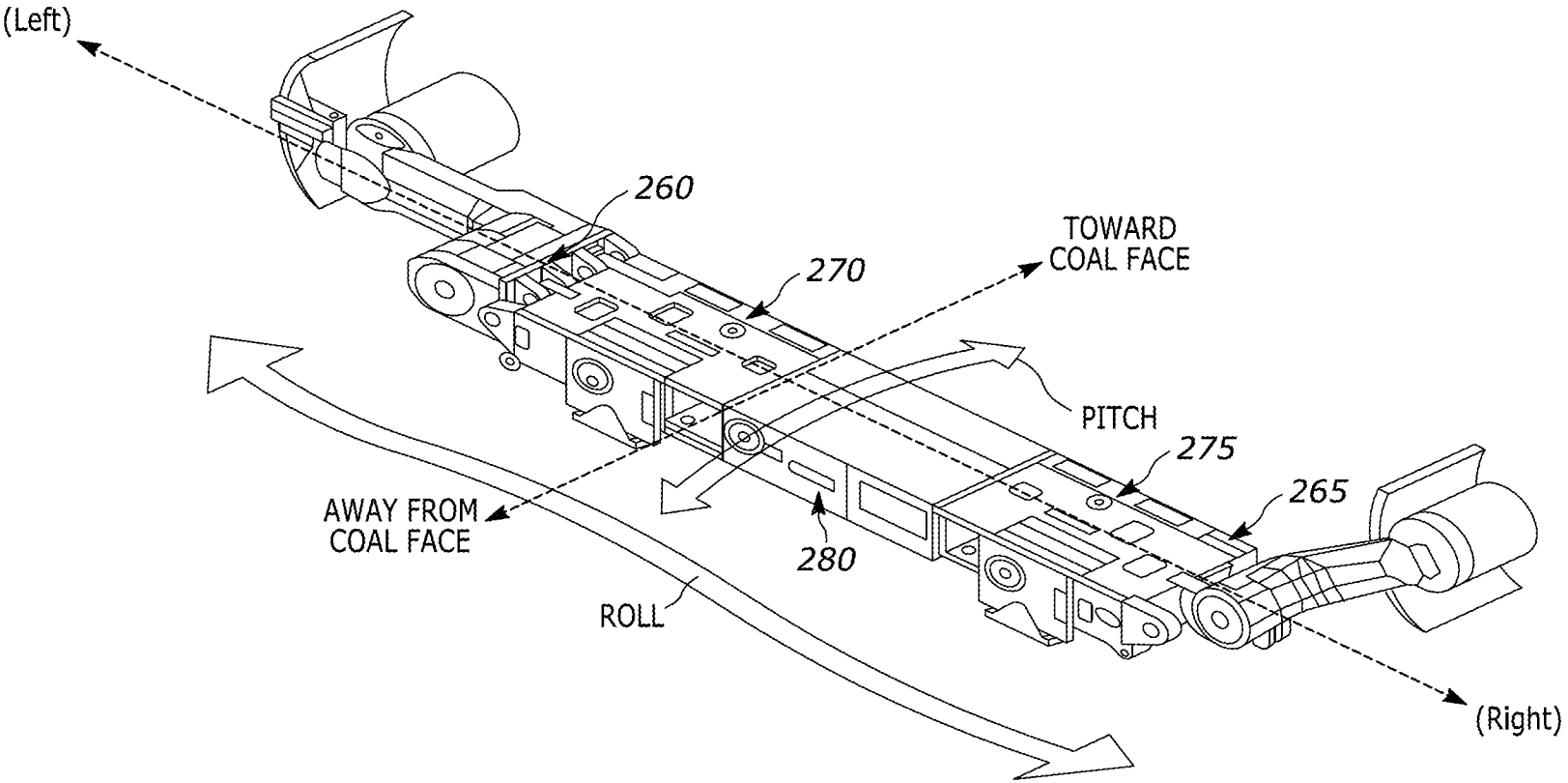

FIGS. 4A, 4B, and 4C illustrate the shearer 120. The shearer 120 includes an elongated central housing 200 (for example, a shearer housing) that stores the operating controls for the shearer 120. Skid shoes 205 and trapping shoes 210 (FIG. 4B) extend below the housing 200. The skid shoes 205 support the shearer 120 on the face side of the AFC 125 (i.e., the side nearest to the material face) and the trapping shoes 210 support the shearer 120 on the goaf side of the AFC 125. Specifically, the trapping shoes 210 and haulage sprockets engage the rack bar of the AFC 125 to allow the shearer 120 to be propelled along the AFC 125 and material face. Extending laterally from the housing 200 are right and left ranging arms 215 and 220 (for example, a first ranging arm and a second ranging arm), respectively, which are raised and lowered by hydraulic cylinders attached to the ranging arms 215, 220 and housing 200. On the distal end of the right ranging arm 215 (with respect to the housing 200) is a right cutting drum 225 (for example, a first cutting drum), and on the distal end of the left ranging arm 220 is a left cutting drum 230 (for example, a second cutting drum). Each cutting drum 225, 230 is driven by an electric motor 235, 240 via the gear train within the ranging arm 215, 220. Each of the cutting drums 225, 230 has a plurality of cutting picks 245 (for example, a first plurality of cutting picks and a second plurality of cutting picks) that abrade the material face as the cutting drums 225, 230 are rotated, thereby cutting away the material. The cutting picks 245 are also accompanied by spray nozzles that spray fluid during the mining process in order to disperse noxious and/or combustible gases that develop at the excavation site, suppress dust, and enhance cooling. FIG. 4B illustrates a side view of the shearer 120 including the cutting drums 225, 230 (shown without cutting picks), ranging arms 215, 220, trapping shoes 210, and housing 200. FIG. 4B also illustrates a left haulage motor 250 and right haulage motor 255.

The shearer 120 also includes various sensors to, for example, enable automatic control of the shearer 120. For example, as illustrated in FIG. 4C, the shearer 120 includes a left ranging arm inclinometer 260, a right ranging arm inclinometer 265, a left haulage gear sensors 270, a right haulage gear sensors 275, and a pitch angle and roll angle sensor 280. FIG. 4C illustrates an approximate location of the various sensors on the shearer 120; but, the sensors are positioned at other locations on the shearer 120 in other embodiments. The inclinometers 260, 265 provide information regarding an angle of slope of the ranging arms 215, 220. Ranging arm position could also be measured with linear transducers mounted between each ranging arm 215, 220 and the housing 200. The haulage gear sensors 270, 275 provide information regarding the position of the shearer 120 along the AFC 125 as well as speed and direction of movement of the shearer 120. The pitch and roll angle sensor 280 provides information regarding the angular alignment of the housing 200. As illustrated in FIG. 4C, the pitch of the shearer 120 refers to an angular tilting toward and away from the material face, while the roll of the shearer 120 refers to an angular difference between the right side of the shearer 120 and the left side of the shearer 120, as more clearly illustrated by the axes in FIG. 4C. Both the pitch and the roll of the shearer 120 can be measured in degrees. Positive pitch refers to the shearer 120 tilting away from the material face (i.e., face side of the shearer 120 is higher than the goaf side of the shearer 120), while negative pitch refers to the shearer 120 tilting toward the material face (i.e., face side of the shearer 120 is lower than the goaf side of the shearer 120). Positive roll refers to the shearer 120 tilting so that the right side of the shearer 120 is higher than the left side of the shearer 120, while negative roll refers to the shearer 120 tilting so that the right side is lower than the left side of the shearer 120. The sensors provide information to determine a relative position of the shearer 120, the right cutting drum 225, and the left cutting drum 230.

Figure 5:
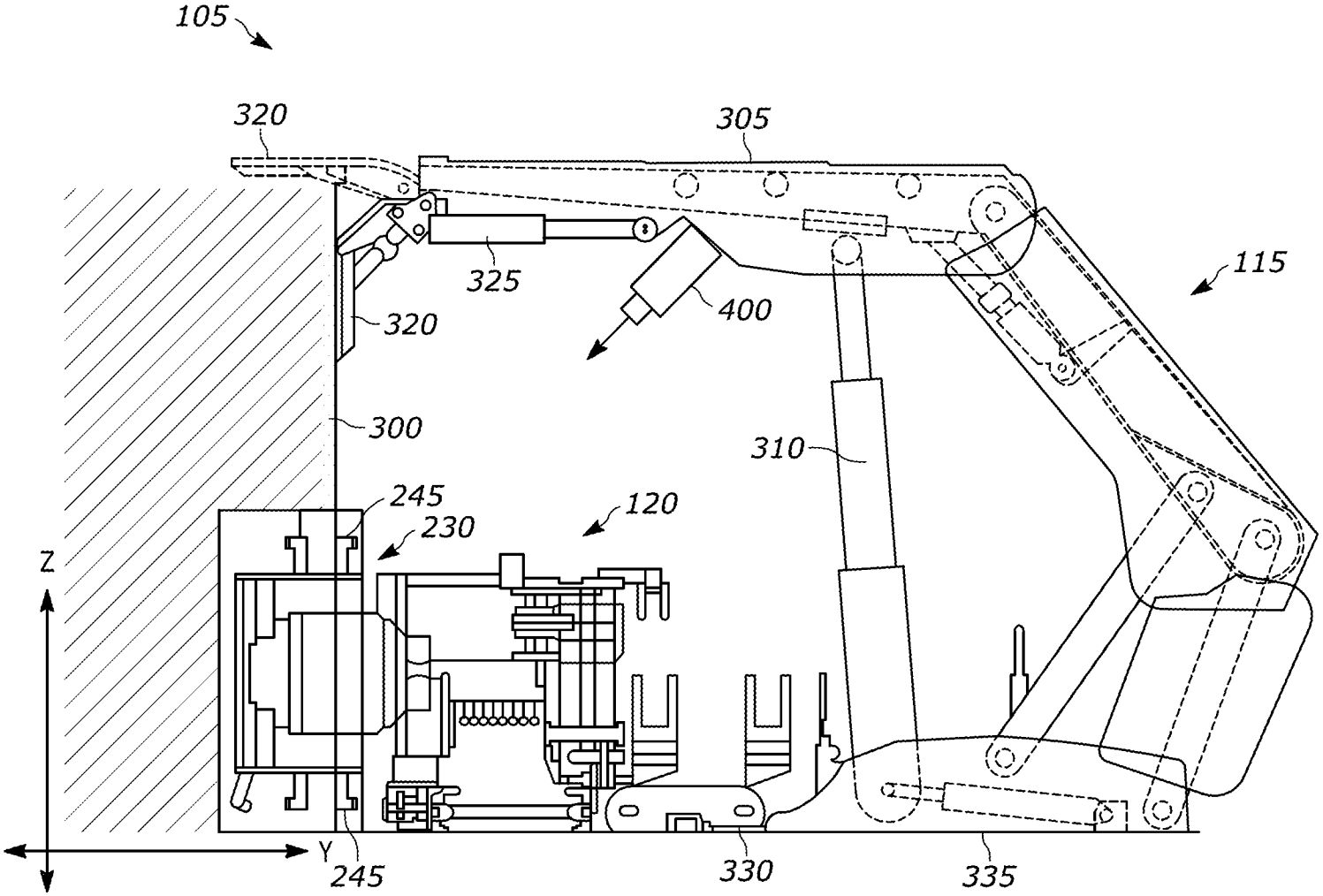
FIG. 5 illustrates a view of a roof support of the longwall mining system of FIG. 2.

FIG. 5 illustrates the longwall mining system 105 as viewed along the line of a material face 300. The roof support 115 is shown shielding the shearer 120 from the strata above by an overhanging canopy 305 of the roof support 115. The canopy 305 is vertically displaced (i.e., moved toward and away from the strata) by hydraulic legs 310, 315 (leg 315 is hidden by leg 310 in FIG. 5, but shown in FIG. 6). The left and right hydraulic legs 310, 315 contain pressurized fluid to support the canopy 305. The canopy 305 exerts a range of upward forces on the geological strata by applying different pressures to the hydraulic legs 310, 315. Mounted to the face end of the canopy 305 is a deflector or sprag 320, which is shown in a face-supporting position in FIG. 5. The sprag 320 can also be fully extended by a sprag ram 325, as shown in ghost in FIG. 5. An advance ram 330 attached to a base 335 allows the roof support 115 to be advanced toward the material face 300 as the layers of material are sheared away to support the newly exposed strata. The advance ram 330 also allows the roof support 115 to push the AFC 125 toward the material face 300.

Figure 6:
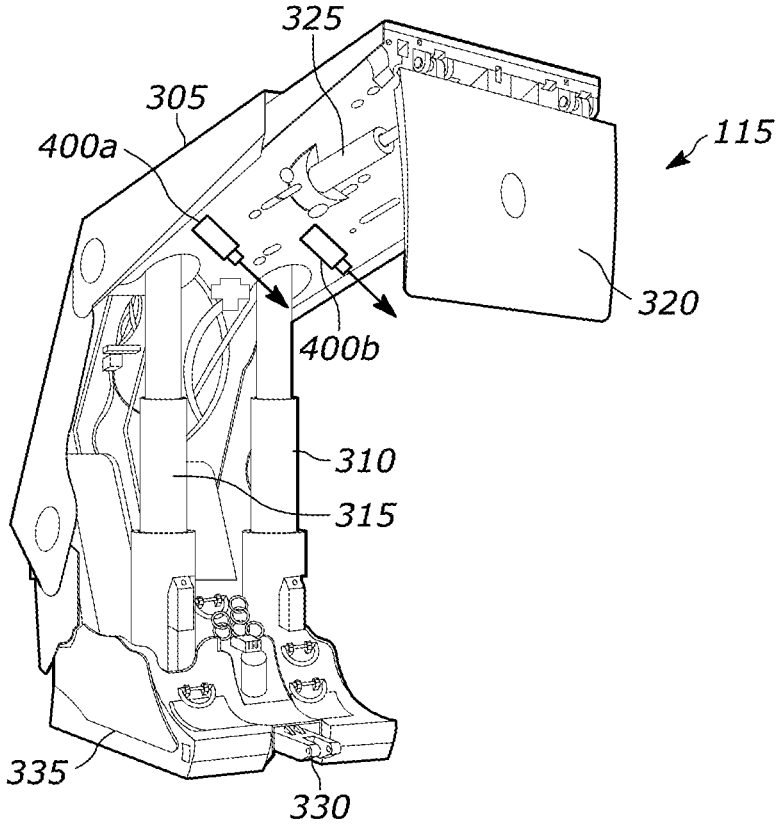
FIG. 6 illustrates another embodiment of a roof support of the longwall mining system of FIG. 2.

FIG. 6 illustrates a perspective view of the roof support 115. In this view, the (left) hydraulic leg 310 and (right) hydraulic leg 315 are illustrated.

As illustrated in FIGS. 3B, 4A-B, 5 and 6, the longwall mining system 105 can also include one or more imaging devices 400 (for example, a first imaging device and a second imaging device) for visually monitoring the cutting picks 245. For example, as shown in FIG. 3B, an imaging device 400*a* is provided on the BSL 145 to monitor the cutting picks 245 of the headgate drum (the cutting drum 225 or 230 of the shearer on the side of the maingate 135). Additionally, as shown in FIG. 3C, an imaging device 400*b* is provided on the AFC drive 130 on the tailgate end 140 to monitor the cutting picks 245 of the tailgate drum (the cutting drum 225 or 230 of the shearer 120 on the side of the tailgate 140. The imaging devices 400*a* and 400*b* may be collectively referred to as the imaging devices 400 and each may generically be referred to as the imaging device 400. As an additional example, the one or more images devices 400 may be mounted to the shearer 120. For example, as shown in FIGS. 4A and 4B, the shearer 120 further includes the imaging device 400*a* coupled to the shearer housing 200 via a right arm 405, and the imaging device 400*b* coupled to the shearer housing 200 via a left arm 410. The right arm 405 and the left arm 410 may be coupled via a hinge or similar device to the shearer housing 200, and may be driven by a motor or hydraulic actuator to retract towards the shearer housing 200 and to swing out away from the shearer housing 200 to position the respective imaging devices 400*a* and 400*b* to have a line of sight of the cutting picks 245 on the respective cutting drums 225 and 230. As another example, one or more roof supports 115 include one or more imaging devices 400. For example, in FIG. 5, a single imaging device 400 is provided on the canopy 305 of the roof support 115. In FIG. 6, two imaging devices 400 are provided on the roof support 115, identified as a first imaging device 400*a* and a second imaging device 400*b*. It should be noted that the imaging devices 400 are not drawn to scale and the imaging devices 400 may include a compact size compared to the size shown in FIGS. 3-6.

The number of imaging devices 400 may vary in the system 105. For example, one or more of the roof supports 115 may each include one or two imaging devices 400 (see FIGS. 5 and 6, respectively). As further examples, (i) one or more of the imaging devices 400 may be mounted to individual roof supports along the material face at regular intervals (e.g., every fifth or tenth roof support 115); (ii) one or more imaging devices 400 may be mounted to a roof support 115 near the main gate, near the tail gate, and at a point halfway between the two gates; (iii) one or more imaging devices 400 may be mounted to a single roof support 115 along the material face; or (iv) one or more imaging devices 400 may be mounted to one or more roof supports 115 in other arrangements along the material face.

In some embodiments, the imaging devices 400 are high speed cameras configured to generate image data. For example, the high speed cameras may operate at more than 250 frames per second (fps), at more than 500 fps, at more than 1000 fps, at more than 5000 fps, at a rate between 250 fps and 5000 fps, or at another rate. In some embodiments, the imaging devices 400 are image-generating radar devices, image-generating lidar devices, other image-generating technology, or combinations thereof. For example, the image-generating radar and lidar devices include a transmitter for transmitting signals (radio waves for radar, light for lidar) and a receiver for receiving reflected signals (radio waves for radar, light for lidar), and a processor for translating the received signals to an image using conventional radar or lidar processing.

Referring to FIG. 3B, a maingate end of the AFC 125 is illustrated. A first AFC drive mechanism 130 is provided at the maingate end of the AFC. An imaging device 400*a* is provided above the first AFC drive mechanism 130. The imaging device 400*a* is coupled to an AFC maingate imaging arm 415 (for example, a first arm) and the AFC maingate imaging arm 415 is provided on a housing of the AFC 125 above the first AFC drive mechanism 130. As discussed above, the AFC maingate imaging arm 415 including the imaging device 400 may also be provided on the BSL 145, for example, above a BSL drive mechanism.

The AFC maingate arm 415 is movable between a first position 420*a* and a second position 420*b*. When the AFC maingate arm 415 is in the first position 420*a*, the AFC maingate arm 415 and the imaging device 400*a* are lifted up such that a cutting drum 225, 230 is within a line of sight of the imaging device 400*a*. The imaging device 400*a* can capture an image of the cutting picks of the cutting drum 225, 230 when the AFC maingate arm 415 is in the first position and the shearer 120 is at the maingate end of the AFC 125. When the AFC maingate arm 415 is in the second position 420*b*, the AFC maingate arm 415 and the imaging device 400*a* are tucked away behind a housing of the AFC drive mechanism 130 away from the shearer 120 such that the dirt and debris during the mining process do not damage the imaging device 400*a*. In some embodiments, the AFC maingate arm 415 is driven by a motor (for example, a first arm motor) between the first position and the second position. In other embodiments, the AFC maingate arm 415 is driven by a hydraulic mechanism (for example, a first hydraulic mechanism) between the first position and the second position.

Referring to FIG. 3B, a tailgate end of the AFC 125 is illustrated. A second AFC drive mechanism 130 is provided at the tailgate end of the AFC. The first AFC drive mechanism 130 and the second AFC drive mechanism 130 may include motors and/or sprockets for driving the AFC 125. An imaging device 400*b* is provided above the second AFC drive mechanism 130. The imaging device 400*b* is coupled to an AFC tailgate imaging arm 425 (for example, a second arm) and the AFC tailgate imaging arm 425 is provided on a housing of the AFC 125 above the second AFC drive mechanism 130 (for example, above a sprocket of the AFC 125). The AFC tailgate imaging arm 425 and the imaging device 400*b* may be operated similarly as the AFC maingate imaging arm 415 and the imaging device 400*a* to capture images of the cutting drums 225, 230.

Referring to FIGS. 4A and 4B, the right arm 405 is provided on the shearer housing 200 by the first ranging arm 215 and the left arm 410 is provided on the shearer housing 200 by the second ranging arm 220. The right arm 405 is movable between a first position and a second position. When the right arm 405 is in the first position, the right arm 405 and the imaging device 400*a* are lifted up such that the cutting drum 225 is within a line of sight of the imaging device 400*a* as shown in FIGS. 4A and 4B. In some embodiments, the imaging device 400*a* may be positioned just above the cutting drum 225 when the right arm 405 is in the first position. The imaging device 400*a* can capture an image of the cutting picks of the cutting drum 225 when the right arm 405 is in the first position. When the right arm 405 is in the second position, the right arm 405 and the imaging device 400*a* are tucked away behind, for example, the right ranging arm 215 away from the cutting drum 225 such that the dirt and debris during the mining process do not damage the imaging device 400*a*.

The left arm 410 is movable between a first position and a second position (for example, a third position and a fourth position). When the left arm 410 is in the first position, the left arm 410 and the imaging device 400*b* are lifted up such that the cutting drum 230 is within a line of sight of the imaging device 400*b* as shown in FIGS. 4A and 4B. In some embodiments, the imaging device 400*b* may be positioned just above the cutting drum 230 when the left arm 410 is in the first position. The imaging device 400*b* can capture an image of the cutting picks of the cutting drum 230 when the left arm 410 is in the first position. When the left arm 410 is in the second position, the left arm 410 and the imaging device 400*b* are tucked away behind, for example, the left ranging arm 220 away from the cutting drum 230 such that the dirt and debris during the mining process do not damage the imaging device 400*b*. As discussed above, the right arm 410 and the left arm 410 may be driven between the first position and the second position using a motor, a hydraulic mechanism, or the like.

Referring to FIGS. 5 and 6, an imaging device 400 may also be mounted to the roof supports 115 such that the imaging device 400 is just above the shearer 120. In these embodiments, the features of the roof support 115, for example the hydraulic legs 310, 315 may act as the first arm and the second arm. The hydraulic legs 310, 315 are actuated to move the roof support forward as the shearer 120 passes the roof support. When in this position, the imaging device 400 may be positioned just above the shearer 120 to capture images of the cutting drums 225, 230. In other embodiments, separate roof support arms may be provided on the roof support to which the imaging device 400 is mounted. The roof support arms may be controlled similar to the right arm 405 and the left arm 410 as discussed above.

Figure 7:
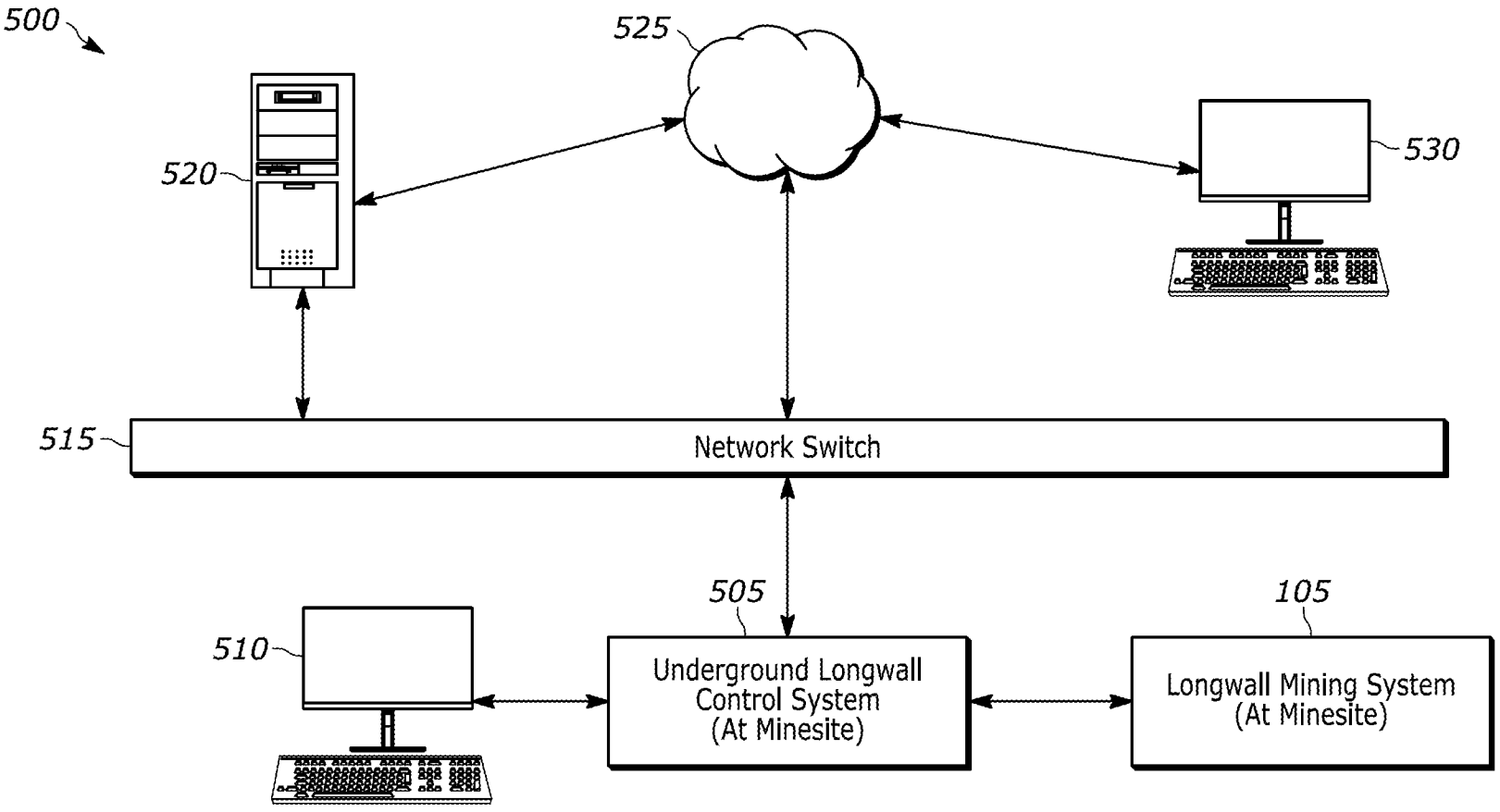
FIG. 7 illustrates a mining monitoring system for use with the longwall mining system of FIG. 2.

FIG. 7 illustrates a mine monitoring and control system 500 that can be used to detect and respond to issues arising in the longwall mining system 105. The mine monitoring and control system 500 is an example of the mine monitoring system 110 of FIG. 1. A controller 505 is, for example, located at the mining site and controls various components of the longwall mining system 105. In some embodiments, the controller 505 is in communication with, but a separate device from, the mining equipment of the longwall mining system 105 (e.g., the shearer 120, AFC 130, and the like). In some embodiments, at least a portion of the controller 505 is integrated into one of the components of the longwall mining system 105 (e.g., the shearer 120, AFC 130, and the like). The controller 505 is in communication with an underground computer or user interface 510 and a surface computer or server 520 via a network switch 515, both of which can also be located at the mine site. The surface computer 520 is further in communication with a remote monitoring computer 530 over a network 525. The remote monitoring computer 530 can be configured to process data received from the surface computer 520 and/or through the network switch 515 from the controller 505.

Each of the components in the mine monitoring system 500 can be communicatively coupled for bi-directional communication. The communication paths between any two components of the mine monitoring system 500 may be wired (e.g., via Ethernet cables), wireless (e.g., via WiFi®, cellular, Bluetooth® protocols), or a combination thereof. Although a single controller 505, user interface 510, and network switch 515 are illustrated in FIG. 7, additional mining machines both underground and surface-related (and alternative to longwall mining) may be coupled to the surface computer 520 via the network switch 515. Similarly, additional network switches or connections may be included in the system 500 to provide alternate communication paths between the controller 505 and the surface computer 520, and between the additional mining machines and the surface computer 520.

Figure 8:
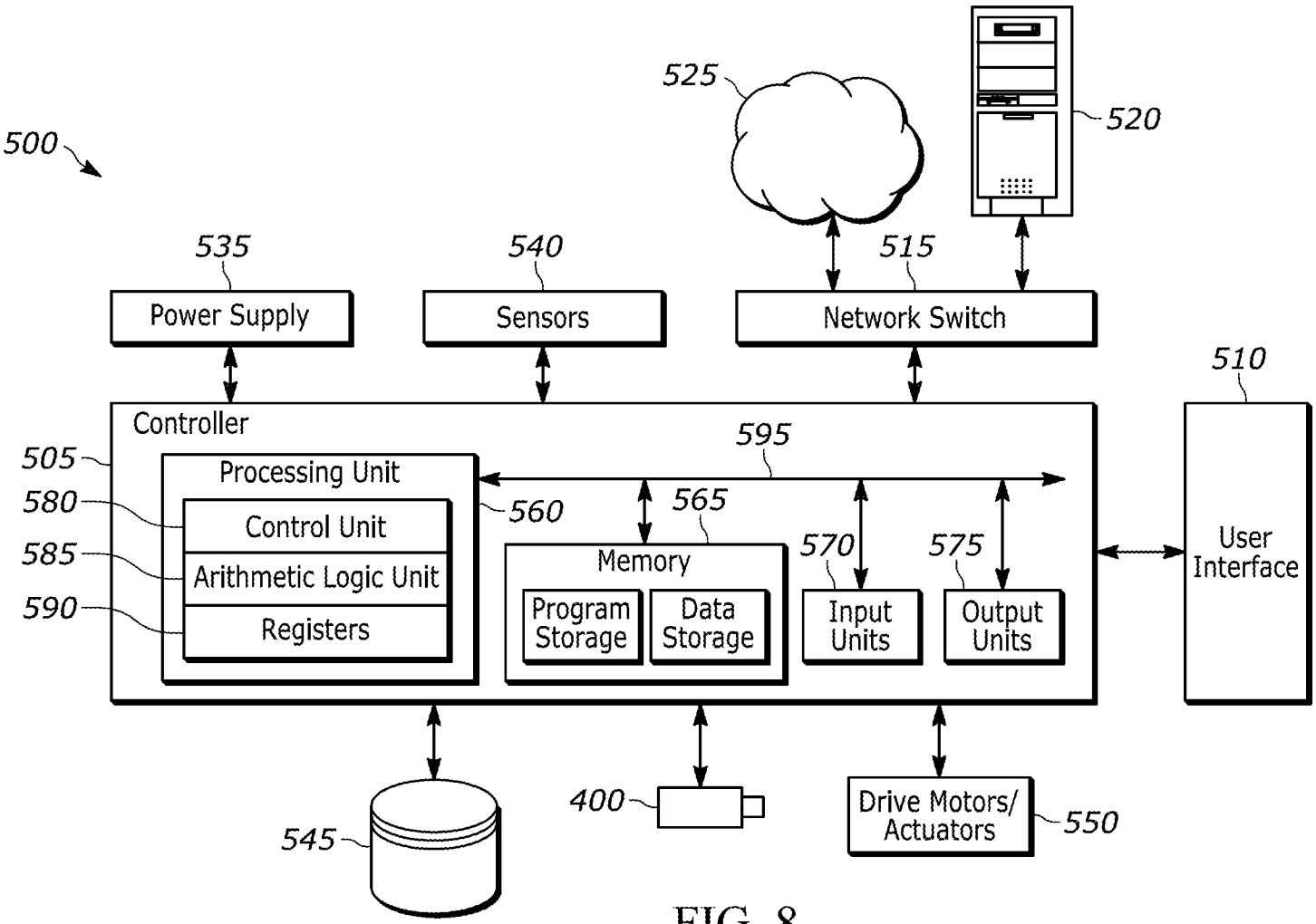
FIG. 8 is a more detailed diagram of the mining monitoring system of FIG. 7.

The mine monitoring system 500 and the controller 505 are illustrated in greater detail with respect to FIG. 8. The controller 505 is electrically and/or communicatively connected to a variety of modules or components of the longwall mining system 105. For example, the controller 505 is connected to the underground computer or user interface 510, the network switch 515, the surface computer or server 520 (via network switch 515), the network 525 (via network switch 515), a power supply module 535 (e.g., an AC power supply module receiving AC mains power), one or more sensors 540 related to the longwall mining system 105, a database 545 (e.g., for storing images or video related to the longwall mining system 105, component profiles, etc.), one or more of the imaging devices 400, and one or more drive motors and actuators 550 of the longwall mining system 105. The one or more drive motors and actuators 550 include one or more of the motors of the longwall system 105, such as the left and right haulage motors 250 and 255 (see FIG. 4B), the motors driving the ranging arms 215, 220 (see FIGS. 4A-B), the motors 235 and 240 driving the cutting drums 225, 230 (see FIGS. 4A-B), the AFC drive motors 130 (see FIGS. 2-3), the sprag ram 325 (see FIGS. 5-6), the hydraulic legs 310, 315 (see FIGS. 5-6), the hydraulics of the advance ram 330 (see FIGS. 5-6), the BSL drive 155 to operate the conveyor of the BSL 145 (see FIG. 3A), the motors and/or hydraulics driving the arms 405 and 410 (see FIGS. 4A and 4B), 415 and 425 (see FIGS. 3B and 3C), and the like.

The controller 505 includes combinations of hardware and software that are operable to, among other things, control the operation of the longwall mining system 105, communicate with the surface computer 520 or over the network 525, receive and analyze image data from the imaging devices 400, among other functions. In some embodiments, the controller 505 includes a plurality of electrical and electronic components that provide power, operational control, and protection to the components and modules within the controller 505 and/or longwall mining system 105. For example, the controller 505 includes, among other things, a processing unit 560 (e.g., a microprocessor, a microcontroller, or another suitable programmable device), a memory 565, input units 570, and output units 575. The processing unit 560 includes, among other things, a control unit 580, an arithmetic logic unit ("ALU") 585, and a plurality of registers 590 (shown as a group of registers in FIG. 8), and is implemented using a known computer architecture (e.g., a modified Harvard architecture, a von Neumann architecture, etc.). The processing unit 560, the memory 565, the input units 570, and the output units 575, as well as the various modules connected to the controller 505 are connected by one or more control and/or data buses (e.g., common bus 595). The control and/or data buses are shown generally in FIG. 8 for illustrative purposes.

The memory 565 is a non-transitory computer readable medium and includes, for example, a program storage area and a data storage area. The program storage area and the data storage area can include combinations of different types of memory, such as a ROM, a RAM (e.g., DRAM, SDRAM, etc.), EEPROM, flash memory, a hard disk, an SD card, or other suitable magnetic, optical, physical, or electronic memory devices. The processing unit 560 is connected to the memory 565 and executes software instructions that are capable of being stored in a RAM of the memory 565 (e.g., during execution), a ROM of the memory 565 (e.g., on a generally permanent basis), or another non-transitory computer readable medium such as another memory or a disc. Software included in the implementation of the longwall mining system 105 can be stored in the memory 565 of the controller 505. The software includes, for example, firmware, one or more applications, program data, filters, rules, one or more program modules, image processing software, and other executable instructions. The controller 505 is configured to retrieve from the memory 565 and execute, among other things, instructions related to the control processes and methods described herein. In other constructions, the controller 505 includes additional, fewer, or different components. In some embodiments, the software included in the implementation of the longwall mining system 105 can be stored in a memory of the surface computer 520 or the remote monitoring computer 530. In such embodiments, the surface computer 520 or the remote monitoring computer 530 is configured to retrieve from the memory and execute instructions related to the control processes and methods described herein.

The sensors 540 include the left ranging arm inclinometer 260, the right ranging arm inclinometer 265, the left haulage gear sensors 270, the right haulage gear sensors 275, and the pitch angle and roll angle sensor 280, as previously described with respect to FIG. 4C. These sensors 540 can be used by the controller 505 in a backward-looking manner to characterize current and/or former state of shearer 120 or the pan-line associated with the longwall mining system 105. In some embodiments, the left and right haulage gear sensors 270 and 275 may be a rotary encoder or similar sensor that indicates an amount of rotation of the right and left haulage gears or motors, which is translated by the controller 505 into a location of the shearer 120 along the material face (e.g., a position along the AFC 125 between the maingate 135 and tailgate 140).

Figure 9:
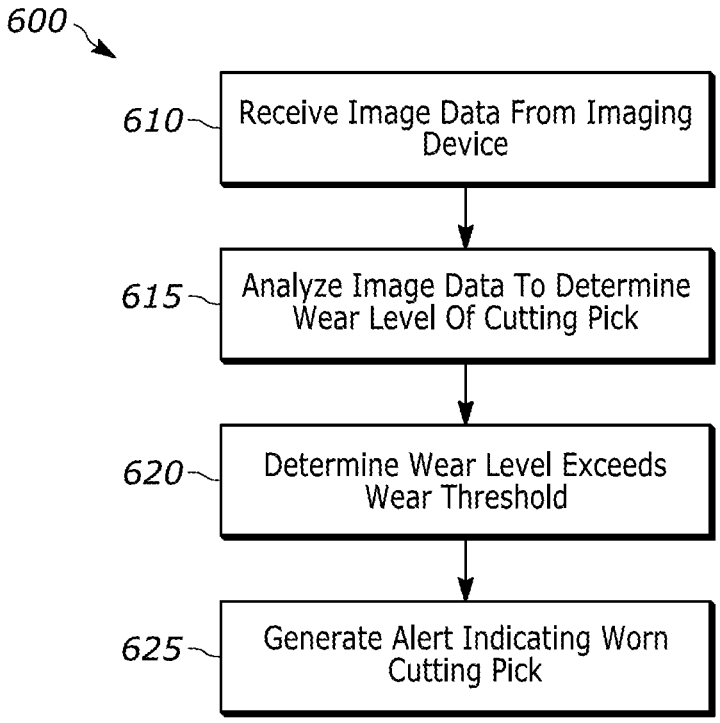
FIG. 9 is flowchart illustrating a method of monitoring cutting picks of a longwall mining system.

FIG. 9 is a flowchart illustrating a method 600 for monitoring cutting picks and controlling the longwall mining system 105. At STEP 610, the controller 505 receives image data of the cutting picks 245 from the one or more imaging devices 400. The image data may take the form of a set of images in one of various file formats (e.g., MPEG, JPEG, or PNG). As previously noted, the imaging devices 400 be one or more selected from the group of high speed cameras, radar imaging devices, lidar imaging devices, among other imaging technologies. The image data may be stored in the memory 565 for future access and analysis by the processing unit 560.

The controller 505 analyzes the image data to determine a wear level of the cutting picks 245 of the shearer 120. (STEP 615). For example, the controller 505 may execute image processing software to identify cutting picks 245 in one or more images of the image data. The controller 505 may then detect attributes of the identified cutting picks 245 (e.g., height, shape, or edge slope), which can be translated into a wear value. For example, height may be inversely proportional to a wear value such that the shorter the height, the higher the wear value (i.e., the more worn the cutting pick). As another example, the shape of a new cutting pick (which may be pre-stored based on manufacturer default settings or detected by the imaging device(s) 400 upon replacement of a cutting drum) may be compared to a detected shape of an identified cutting pick 245. A value may be assigned based on the difference in shape between the new cutting pick shape and the detected shape, where the more different the shapes, the higher the wear value. In some embodiments, a wear level is provided for each cutting pick 245 identified from the image data. In some embodiments, a wear level is provided for each cutting drum as an average of wear levels for individual cutting picks 245 identified from the image data.

Based on the analysis, the controller 505 determines that one or more of the cutting picks 245 exceed a wear threshold (STEP 620). For example, in some embodiments, the controller 505 compares the wear value for each cutting pick 245 determined in STEP 615 to a wear threshold. When the wear threshold is exceeded by a wear value of one or more cutting picks 245, the controller 505 determines that the one or more of the cutting picks 245 associated with the wear value exceeds the wear threshold. Although not shown, in the event that the wear level is determined to not exceed a wear threshold after the analysis in STEP 615, the method may loop back to STEP 610 to retrieve further image data and restart the process.

In response to determining that one or more of the cutting picks 245 exceeds a wear threshold, the controller 505 generates an alert indicating that the one or more cutting picks 245 are worn and should be replaced (STEP 625). For example, in some embodiments, the controller 505 generates an alert on a component associated with the longwall mining system 105 to notify an operator or mine supervisor of the worn cutting pick(s). For example, the controller 505 may generate an audible, visual, and/or tactile alert provided via the user interface 510, via a component of the longwall mining system 105 (e.g., the shearer 120, one of the roof supports 115, etc.), or via the remote monitoring computer 530 (by way of the network switch 515). The alert may be provided by a speaker, electronic display, and/or vibrating element of the user interface 510, of the component of the longwall mining system 105, or of the remote monitoring computer 530. In other words, the controller 505 communicates a request to the component associated with the longwall mining system 105 to effect the alert, thereby controlling the associated component. In turn, an operator or mine supervisor near the component is prompted to retrieve replacement cutting drums 225, 230 or cutting picks 245 to replace those identified as worn. The alert may identify which of the one or more cutting picks 245 are worn and should be replaced, the amount of wear of the one or more picks 245 that are considered worn, an indication of the timing when the one or more cutting picks 245 should be replaced (e.g., immediately, within the next week, etc.), or a combination thereof.

In some embodiments, the method 600 is executed independently for each cutting drum 225 and 230 and based on the image data from a respective one of the imaging devices 400 associated with the particular cutting drum 225 or 230. In some embodiments, such as where a single imaging device 400 is provided on a roof support 115 (see, e.g., FIG. 5), the method is executed in a first time period as the first cutting drum 225 is positioned by the imaging device 400 on the roof support 115, and then executed in a second, later time period when the second cutting drum 230 is positioned by the imaging device 400. Because the roof support 115 is statically positioned along the AFC 125 while the shearer 120 is operable to move along the AFC 125, a single imaging device 400 is operable to monitor the cutting picks 245 of both cutting drums 225 and 230.

Although the method 600 is described with respect to the controller 505 located at the mine site, in some embodiments, the controller implementing the method 600 is located remotely. For example, the controller of the method 600 may be implemented by the remote monitoring computer 530 or the surface computer 520, or by a combination of one or more of the controller 505, the remote monitoring computer 530, and the surface computer 520. Additionally, the steps of the process 600 are illustrated in an example order. However, various steps of the illustrated process 600 are capable of being removed from the process 600, of being performed in a different order than the particular order illustrated in FIG. 9, and of being performed at least partially in parallel with one another.

Figure 10:
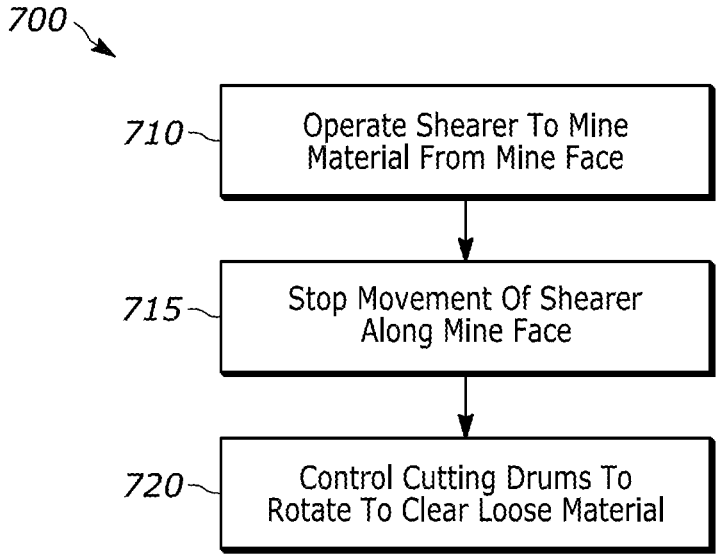
FIG. 10 is a flowchart illustrating a method for monitoring cutting picks and controlling the longwall mining system of FIG. 2.

In some embodiments, the process 600 includes additional steps executed before STEP 610. FIG. 10 is a flowchart illustrating a method 700 for monitoring cutting picks and controlling the longwall mining system 105. For example, in some embodiments, the method 700 is performed before or concurrently with the method 600. As shown in FIG. 10, the method 700 includes operating the shearer 120 of the longwall mining system 105 to mine material from a mine face in a typical manner (STEP 710). To operate the shearer 120, the controller 505 generates one or more control signals for the drive motors and actuators 550 of the longwall mining system 105. For example, the control signals include one or more of: signals driving the left and right haulage motors 250 and 255 to causing the shearer 120 to move along the AFC 125 (and, therefore, along the material face), signals controlling the ranging arms 215, 220 to desired heights, and signals driving the motors 235 and 240 to drive the cutting drums 225, 230. In some embodiments, in addition to operating the shearer 120, the process further includes controlling other components of the longwall mining system 105, such as by generating one or more of signals controlling the AFC drive motors 130 to drive the conveyor of the AFC 125, signals controlling the advance ram 330 to advance the roof supports 115 and AFC after the shearer 120 passes, signals controlling the sprag ram 325 (see FIGS. 5-6), signals controlling the hydraulic legs 310, 315), signals operating the crusher 150, signals driving the BSL drive 155 to operate the conveyor of the BSL 145, and the like.

The method 700 further includes stopping movement of the shearer along the mine face (STEP 715). For example, the controller 505 generates one or more control signals to stop the left and right haulage motors 250 and 255 to cause the shearer 120 to stop moving along the AFC 125 (and, therefore, along the material face). In some embodiments, the shearer 120 is stopped at a predetermined location along the mine face to align one or more of the cutting drums 225, 230 with one or more of the imaging devices 400. By stopping at the aligned location, the one or more imaging devices 400 are able to capture image data of the cutting picks 245 of the respectively aligned cutting drums 225 or 230. For example, stopping movement of the shearer 120 along the mine face may further include determining that a cutting drum 225 or 230 of the shearer 120 is aligned with one of the imaging devices 400 for capture of the image data.

The location of the imaging devices 400 may be predetermined and stored in the memory 565 of the controller 505 (e.g., by an operator during a setup or configuration stage). The location of the shearer 120 may be indicated by the sensors 540 to the controller 505 such that the controller can determine whether a current location of the shearer 120 along the material face matches the predetermined location of one of the imaging devices 400. For example, the current location may be represented by a numerical value as a distance from the maingate 135 (or tailgate 140), and the predetermined location may be similarly indicated by a numerical value as a distance from the maingate 135 (or tailgate 140). The controller 505 may then be configured to determine that the current location of the shearer 120 matches the predetermined location based on a comparison of the numerical value of the current location and of the predetermined location indicating that the values are equal or within a certain range of one another.

The method 700 also includes controlling one or both of the cutting drums 225 and 230 to rotate after the shearer 120 has stopped to clear loose material from the cutting drum(s) 225, 230 (STEP 720). For example, the cutting drums 225 and 230 may be controlled to rotate for a predetermined amount of time to ensure that loose material engaged to the cutting drums 225 and 230 after the shearer 120 stops translating along the material face is able to fall away. After the loose material is cleared from the cutting drums 225 and 230, the one or more imaging devices 400 are configured to capture the image data, which is then received by the controller 505 in STEP 610. By enabling the loose material to be cleared from the cutting drums 225 and 230, the one or more imaging devices 400 are able to capture clearer images of the cutting picks 245 for analysis of wear.

In some embodiments, the cutting drums 225 and 230 are further configured to stop or to be rotated slowly (e.g., only a percentage of the rotation speed of the cutting drums 225 and 230 during normal operation) as the one or more imaging devices 400 capture the image data. By enabling controlling the cutting drums 225 and 230 to stop or to rotate slowly, the one or more imaging devices 400 are able to capture clearer images of the cutting picks 245 for analysis of wear. In some embodiments, when the shearer 120 is stopped for capturing images, the cutting drums 225 and 230, the controller 505 may rest the cutting drums 225 and 230 on the mine floor. The controller 505 controls the shearer 120 to tram when the cutting drums 225 and 230 are resting on the floor causing the cutting drums 225 and 230 rotate slowly. The images of the cutting picks on the cutting drums 225 and 230 are then captured as discussed above.

In some embodiments, the process 600 is implemented periodically by the controller 505, for example, once an hour, once a day, after each pass of the shearer along the mine face, after every five passes of the shearer along the mine face, etc.

Figure 11:
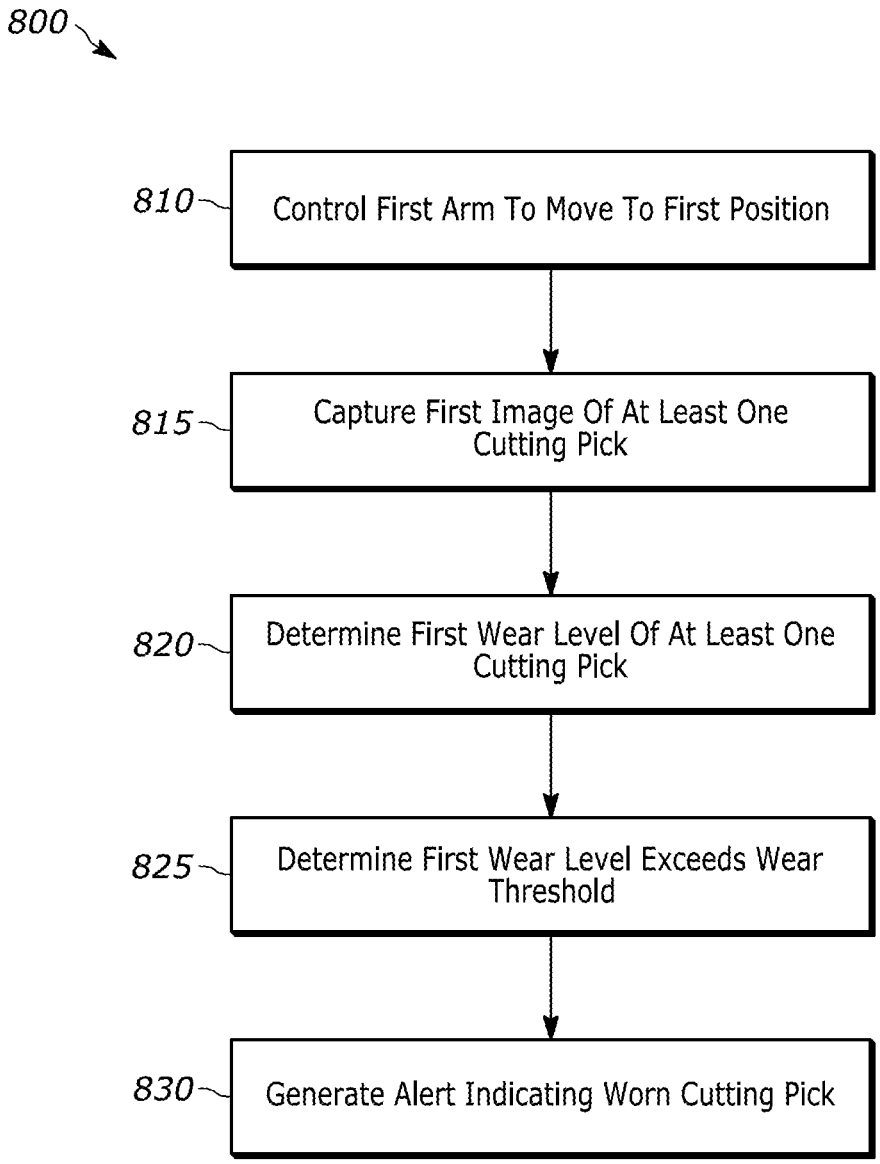
FIG. 11 is a flowchart illustrating a method for monitoring cutting picks and controlling the longwall mining system of FIG. 2.

FIG. 11 is a flowchart illustrating a method 800 for monitoring cutting picks 245 and controlling the longwall mining system 105. The method 800 may be implemented similar to the method 600 and may be implemented after or concurrently with method 700. At STEP 810, the controller 505 controls a first arm to move to a first position. The controller 505 controls the motor and/or hydraulics that actuates one of the arms 405, 410, 415, 425 (that is, the first arm). The first arm moved to the first position such that one or both of cutting drums 225 and 230 are within a line of sight of the first imaging device 400 mounted to the first arm.

At STEP 815, the controller 505 captures, using the first imaging device 400, a first image of at least one of the cutting picks 245 of a first plurality of cutting picks 245. The first plurality of cutting picks 245 are, for example, the plurality of cutting picks 245 on one of the cutting drums 225 and 230. Prior to capturing the first image, the controller 505 may verify that the cutting drum 225 is within a line of sight of the first imaging device 400.

The controller 505 analyzes the first image to determine a first wear level of the at least one cutting pick 245 of the first plurality of cutting picks (STEP 820). For example, the controller 505 may execute image processing software to identify cutting picks 245 in one or more images of the image data. The controller 505 may then detect attributes of the identified cutting picks 245 (e.g., height, shape, or edge slope), which can be translated into a wear value. For example, height may be inversely proportional to a wear value such that the shorter the height, the higher the wear value (i.e., the more worn the cutting pick). As another example, the shape or geometry of a new cutting pick (for example, a geometry of an unworn cutting pick) may be compared to a detected shape or geometry of an identified cutting pick 245. The controller 505 determines a geometry of the at least one cutting pick 245 in the first image using image analysis techniques. The controller 505 determines a difference between the geometry of the at least one cutting pick 245 in the first image and a reference geometry of the new cutting pick. The difference between the respective geometries or shapes is identified as the first wear level. In some embodiments, a wear level is provided for each cutting pick 245 identified from the image data. In some embodiments, a wear level is provided for each cutting drum as an average of wear levels for individual cutting picks 245 identified from the image data.

Based on the analysis, the controller 505 determines that the first wear level exceeds a wear threshold (STEP 825). For example, in some embodiments, the controller 505 compares the wear value for each cutting pick 245 determined in STEP 820 to a wear threshold. When the wear threshold is exceeded by a wear value of one or more cutting picks 245, the controller 505 determines that the one or more of the cutting picks 245 associated with the wear value exceeds the wear threshold. Although not shown, in the event that the wear level is determined to not exceed a wear threshold after the analysis in STEP 820, the method may loop back to STEP 810 to retrieve further image data and restart the process.

In response to determining that the first wear level exceeds the wear threshold, the controller 505 generates an alert indicating that the at least one cutting pick 245 is worn and should be replaced (STEP 830). For example, in some embodiments, the controller 505 generates an alert on a component associated with the longwall mining system 105 to notify an operator or mine supervisor of the worn cutting pick(s) 245. For example, the controller 505 may generate an audible, visual, and/or tactile alert provided via the user interface 510, via a component of the longwall mining system 105 (e.g., the shearer 120, one of the roof supports 115, etc.), or via the remote monitoring computer 530 (by way of the network switch 515). The alert may be provided by a speaker, electronic display, and/or vibrating element of the user interface 510, of the component of the longwall mining system 105, or of the remote monitoring computer 530. In other words, the controller 505 communicates a request to the component associated with the longwall mining system 105 to effect the alert, thereby controlling the associated component. In turn, an operator or mine supervisor near the component is prompted to retrieve replacement cutting drums 225, 230 or cutting picks 245 to replace those identified as worn. The alert may identify which of the one or more cutting picks 245 are worn and should be replaced, the amount of wear of the one or more picks 245 that are considered worn, an indication of the timing when the one or more cutting picks 245 should be replaced (e.g., immediately, within the next week, etc.), or a combination thereof.

Thus, embodiments described herein provide, among other things, systems and methods for monitoring cutting picks of a shearer and generating alerts based on detected wear of one or more cutting picks.

The invention claimed is:

1. A longwall mining system comprising:

a longwall shearer configured to move along a mine face;

a first cutting drum provided on the longwall shearer and including a first plurality of cutting picks configured to cut material from the mine face as the longwall shearer moves along the mine face;

a first imaging device configured to capture one or more images of the first cutting drum;

a first arm movable between a first position and a second position, wherein the first imaging device is mounted to the first arm, wherein when the first arm is in the first position the first cutting drum is within a line of sight of the first imaging device, and wherein when the first arm is in the second position the first cutting drum is out of view of the first imaging device; and an electronic processor electrically coupled to the longwall shearer, the first cutting drum, the first arm, and the imaging device and configured to control the first arm to move to the first position;

capture, using the first imaging device, a first image of at least one of the cutting picks of the first plurality of cutting picks, analyze the first image to determine a first wear level of the at least one cutting pick of the first plurality of cutting picks;

determine that the first wear level exceeds a wear threshold; and generate a first alert indicating that the at least one cutting pick of the first plurality of cutting picks is worn in response to determining that the first wear level exceeds the wear threshold.

2. The longwall mining system of claim 1, further comprising:

a second cutting drum provided on the longwall shearer and including a second plurality of cutting picks;

a second imaging device configured to capture one or more images of the second cutting drum; and a second arm movable between a third position and a fourth position, wherein the second imaging device is mounted to the second arm, wherein when the second arm is in the third position the second cutting drum is within a line of sight of the second imaging device, and wherein when the second arm is in the fourth position the second cutting drum is out of view of the second imaging device, wherein the electronic processor is electrically coupled to the second cutting drum and the second arm, and the electronic processor is further configured to:

control the second arm to move to the third position;

capture, using the second imaging device, a second image of at least one of the cutting picks of the second plurality of cutting picks, analyze the second image to determine a second wear level of the at least one cutting pick of the second plurality of cutting picks;

determine that second wear level exceeds the wear threshold; and generate a second alert indicating that the at least one cutting pick of the second plurality of cutting picks is worn in response to determining that the second wear level exceeds the wear threshold.

3. The longwall mining system of claim 2, wherein the longwall shearer further comprises:

a shearer housing including a first ranging arm on a first end of the shearer housing and a second ranging arm on a second end of the shearer housing opposite the first end, wherein the first cutting drum is mounted to the first ranging arm and the second cutting drum is mounted to the second ranging arm, and wherein the first arm is provided on the shearer housing by the first ranging arm and the second arm is provided on the shearer housing by the second ranging arm.

4. The longwall mining system of claim 2, further comprising:

an armored face conveyor (AFC) including a maingate end and a tailgate end and configured to transport material cut by the first cutting drum to the maingate end;

a first armored face conveyor (AFC) drive mechanism located at a maingate end of the AFC;

a second armored face conveyor (AFC) drive mechanism located at a maingate end of the AFC, the first AFC drive mechanism and the second AFC drive mechanism configured to drive the AFC, wherein the first arm is provided above the first AFC drive mechanism and the second arm is provided above the second AFC drive mechanism.

5. The longwall mining system of claim 2, further comprising:

a plurality of roof supports interconnected parallel to the mine face by electrical and hydraulic connections, wherein the first arm is mounted to a first roof support of the plurality of roof supports above the longwall shearer and the second arm is mounted to a second roof support of the plurality of roof supports above the longwall shearer.

6. The longwall mining system of claim 1, further comprising:

an armored face conveyor (AFC) including a maingate end and a tailgate end and configured to transport material cut by the first cutting drum to the maingate end; and a first armored face conveyor (AFC) drive mechanism located at a maingate end of the AFC and configured to drive the AFC, wherein the first arm is provided above the first AFC drive mechanism.

7. The longwall mining system of claim 1, further comprising:

a plurality of roof supports interconnected parallel to the mine face by electrical and hydraulic connections, wherein the first arm is mounted to a first roof support of the plurality of roof supports above the longwall shearer.

8. The longwall mining system of claim 1, wherein the electronic processor is further configured to operate the longwall shearer to mine material from the mine face, wherein operation of the longwall shearer includes controlling the longwall shearer to move along the mine face and controlling the first cutting drum to rotate;

stop movement of the longwall shearer along the mine face; and control the first cutting drum to rotate after the shearer has stopped to clear loose material from the first cutting drum, wherein the first image is captured after the loose material is cleared.

9. The longwall mining system of claim 8, wherein the electronic processor is further configured to determine that the first cutting drum is aligned with first imaging device for capture of the first image data; and in response to determining that the first cutting drum is aligned with the first imaging device, stopping movement of the longwall shearer along the mine face.

10. The longwall mining system of claim 8, wherein the electronic processor is further configured to rest the first cutting drum on the mine floor; and control the longwall shearer to tram causing the first cutting drum to rotate, wherein the first image is captured when the first cutting drum is rotating.

11. The longwall mining system of claim 1, further comprising:

a first arm motor driving the first arm between the first position and the second position, wherein the electronic processor is configured to control the first arm motor to move the first arm between the first position and the second position.

12. The longwall mining system of claim 1, further comprising:

a first hydraulic mechanism driving the first arm between the first position and the second position, wherein the electronic processor is configured to control the first hydraulic mechanism to move the first arm between the first position and the second position.

13. The longwall mining system of claim 1, wherein the electronic processor is further configured to determine a geometry of the at least one cutting pick of the first plurality of cutting picks; and determine a difference between the geometry of the at least one cutting pick of the first plurality of cutting picks and a reference geometry of a new cutting pick, wherein the first wear level is the difference between the geometry of the at least one cutting pick of the first plurality of cutting picks and the reference geometry of the new cutting pick.

14. A method for monitoring a longwall mining system including a longwall shearer configured to move along a mine face and a first cutting drum provided on the longwall shearer and including a first plurality of cutting picks configured to cut material from the mine face as the longwall shearer moves along the mine face, the method comprising:

controlling, using an electronic processor of the longwall mining system, a first arm to move to a first position, wherein a first imaging device is mounted to the first arm, wherein the first arm is movable between the first position and a second position, wherein when the first arm is in the first position the first cutting drum is within a line of sight of the first imaging device, and wherein when the first arm is in the second position the first cutting drum is out of view of the first imaging device;

capturing, using the first imaging device, a first image of at least one of the cutting picks of the first plurality of cutting picks, analyzing, using the electronic processor, the first image to determine a first wear level of the at least one cutting pick of the first plurality of cutting picks;

determining, using the electronic processor, that the first wear level exceeds a wear threshold; and generating, using the electronic processor, a first alert indicating that the at least one cutting pick of the first plurality of cutting picks is worn in response to determining that the first wear level exceeds the wear threshold.

15. The method of claim 14, wherein the longwall mining system further includes a second cutting drum provided on the longwall shearer and including a second plurality of cutting picks, the method further comprising:

controlling, using the electronic processor, a second arm to move to a third position, wherein a second imaging device is mounted to the second arm, wherein the second arm is movable between the third position and a fourth position, wherein when the second arm is in the third position the second cutting drum is within a line of sight of the second imaging device, and wherein when the second arm is in the fourth position the second cutting drum is out of view of the second imaging device;

capturing, using the second imaging device, a second image of at least one of the cutting picks of the second plurality of cutting picks, analyzing, using the electronic processor, the second image to determine a second wear level of the at least one cutting pick of the second plurality of cutting picks;

determining, using the electronic processor, that the second wear level exceeds the wear threshold; and generating, using the electronic processor, a second alert indicating that the at least one cutting pick of the second plurality of cutting picks is worn in response to determining that the second wear level exceeds the wear threshold.

16. The method of claim 14, further comprising:

operating the longwall shearer to mine material from the mine face, wherein operation of the longwall shearer includes controlling the longwall shearer to move along the mine face and controlling the first cutting drum to rotate;

stopping movement of the longwall shearer along the mine face; and controlling the first cutting drum to rotate after the shearer has stopped to clear loose material from the first cutting drum, wherein the first image is captured after the loose material is cleared.

17. The method of claim 16, further comprising:

determining that the first cutting drum is aligned with first imaging device for capture of the first image data; and in response to determining that the first cutting drum is aligned with the first imaging device, stopping movement of the longwall shearer along the mine face.

18. The method of claim 16, further comprising:

resting the first cutting drum on the mine floor; and controlling the longwall shearer to tram causing the first cutting drum to rotate, wherein the first image is captured when the first cutting drum is rotating.

19. The method of claim 14, further comprising:

determining a geometry of the at least one cutting pick of the first plurality of cutting picks; and determining a difference between the geometry of the at least one cutting pick of the first plurality of cutting picks and a reference geometry of a new cutting pick, wherein the first wear level is the difference between the geometry of the at least one cutting pick of the first plurality of cutting picks and the reference geometry of the new cutting pick.

* * * * *